US010189283B2

(12) United States Patent
Zirilli

(10) Patent No.: US 10,189,283 B2
(45) Date of Patent: Jan. 29, 2019

(54) VACUUM MEDIA TRANSPORT SYSTEM WITH REDUCED PRESSURE VARIATIONS IN INTER-COPY GAPS

(71) Applicant: Xerox Corporation, Norwalk, CT (US)

(72) Inventor: Francisco Zirilli, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 8 days.

(21) Appl. No.: 15/602,905

(22) Filed: May 23, 2017

(65) Prior Publication Data

US 2018/0339529 A1 Nov. 29, 2018

(51) Int. Cl.
*B41J 11/06* (2006.01)
*B41J 11/00* (2006.01)

(52) U.S. Cl.
CPC ..... *B41J 11/0085* (2013.01)

(58) Field of Classification Search
CPC combination set(s) only.
See application file for complete search history.

(56) References Cited

U.S. PATENT DOCUMENTS 3,799,541 A 3/1974 Buccicone
3,889,801 A * 6/1975 Boyer ..... B65G 15/58 198/689.1
4,298,277 A 11/1981 Silverberg
4,595,501 A 6/1986 Queyroix
4,659,469 A 4/1987 Gaudfrin
5,124,728 A * 6/1992 Denda ..... B41J 11/06 346/104
5,717,446 A 2/1998 Teumer et al.
5,906,840 A * 5/1999 Bosler ..... B29C 51/24 264/555
6,270,074 B1 * 8/2001 Rasmussen ..... B41J 11/0025 271/183
6,648,198 B2 * 11/2003 Demers ..... D21G 9/0063 226/95
7,922,174 B2 * 4/2011 Panides ..... B41J 11/007 198/471.1
8,182,081 B2 * 5/2012 Yamamoto ..... B41J 11/007 347/101
8,382,276 B2 * 2/2013 Ikeda ..... B41J 11/0085 347/101
8,491,072 B2 * 7/2013 Yamagishi ..... B41J 2/155 347/14
8,695,783 B2 * 4/2014 Gilmartin ..... B29D 29/06 198/689.1
8,764,012 B2 * 7/2014 Akihiro ..... B41J 11/007 271/276
8,939,574 B2 * 1/2015 Cressman ..... B41J 11/001 347/104
9,283,779 B2 * 3/2016 Hobo ..... B41J 11/0085
(Continued)

*Primary Examiner* — Matthew Luu
*Assistant Examiner* — Lily Kemathe
(74) *Attorney, Agent, or Firm* — Maginot Moore & Beck LLP

(57) ABSTRACT

A media transport system includes a vacuum plenum and a belt positioned over the vacuum plenum. The belt includes at least one member having a first region and a second region that both include holes that enable the vacuum plenum to apply a force to hold print media against the belt. The belt also includes slots formed through the at least one member in an inter-copy gap positioned between the first region and the second region. Each slot is formed with a larger area than an area of each hole.

14 Claims, 5 Drawing Sheets

(56) References Cited

U.S. PATENT DOCUMENTS

| | | | | |
|---|---|---|---|---|
| 9,604,813 | B1 * | 3/2017 | Herrmann | B65H 29/242 |
| 2002/0041068 | A1 * | 4/2002 | Madsen | B41J 11/0025 271/183 |
| 2005/0147454 | A1 | 7/2005 | Spence et al. | |
| 2010/0084803 | A1 * | 4/2010 | Akihiro | B41J 11/007 271/3.22 |
| 2011/0057380 | A1 * | 3/2011 | Maeyama | B41J 11/0025 271/11 |
| 2011/0242220 | A1 * | 10/2011 | Yamagishi | B41J 11/0085 347/47 |
| 2012/0236101 | A1 * | 9/2012 | Kato | B41J 11/0085 347/104 |
| 2015/0336406 | A1 * | 11/2015 | Hobo | B41J 11/007 347/104 |

* cited by examiner

VACUUM MEDIA TRANSPORT SYSTEM WITH REDUCED PRESSURE VARIATIONS IN INTER-COPY GAPS

TECHNICAL FIELD

This disclosure is directed to printers and, more particularly, to media transport systems that use belts to transport print media in inkjet printers.

BACKGROUND

Inkjet printers form printed images using one or more printheads, each one of which includes an array of inkjet ejectors. A controller in the printer operates the ejectors to form printed images that often include both text and graphics and may be formed using one or more ink colors. Some inkjet printers move print media, such as paper sheets, envelopes, or any other article suitable for receiving printed images, on a belt past one or more printheads to receive the ink drops that form the printed image. Many printers that use belts to transport print media use a vacuum plenum and belts that have holes to generate a suction force through the surface of the belt. Each print medium engages a portion of the holes on the surface of the belt and the suction force holds the print medium to the surface of the belt to prevent the print media from slipping or otherwise moving relative to the surface of the belt as the belt moves through the printer. Holding each print medium in place relative to the surface of the moving belt enables the printer to control the timing of the operation of printheads to ensure that the printheads form printed images in proper locations on each print medium and ensures that the print media do not cause jams or other mechanical issues with the printer. In large-scale printer configurations, the belt often carries multiple print media simultaneously.

One problem with belts that carry print media over a vacuum plenum is that the print media do not completely cover every hole on the belt. For example, as a belt carries two or more print media, a gap between sheets of consecutive print media includes holes that are exposed to the vacuum plenum. The suction force of the vacuum plenum draws air through the exposed holes near the edges of the print media, which produces airflow and deviations in pressure in a region around the inter-copy gap. As the inter-copy gap moves past the printheads, the variations in pressure can negatively affect the meniscuses of liquid ink held within the nozzles of the inkjets in the printheads. In some instances, inkjets become inoperable when the variations in air pressure either draw ink from a nozzle in an undesirable manner or push the ink upwards into the nozzle. Either occurrence often results in an inoperable inkjet that can only be returned to service via a cleaning process that requires interruption of operations in the printer. Consequently, improvements to media transport systems that reduce or eliminate the occurrences of inoperable inkjets due to variations in air pressure within a print zone would be desirable.

SUMMARY

In one embodiment, a media transport system for an inkjet printer that reduces air flow at inter-copy gaps between media on a belt moving over a vacuum plenum has been developed. The media transport system includes a vacuum plenum and a belt positioned over the vacuum plenum. The belt includes at least one member configured to carry print media in a process direction, a first plurality of holes formed through the at least one member in a first region that carries a first print medium to enable the vacuum plenum to apply a force to hold the first print medium against the at least one member of the belt, a second plurality of holes formed through the at least one member in a second region that carries a second print medium to enable the vacuum plenum to apply the force to hold the second print medium against the at least one member of the belt, and a plurality of slots formed through the at least one member in a third region corresponding to an inter-copy gap that is positioned between the first region and the second region, each slot in the plurality of slots being formed with a first area that is greater than a second area occupied by one hole in the first plurality of holes or the second plurality of holes.

In another embodiment, a printer including a media transport system that reduces air flow at inter-copy gaps between media on a belt moving over a vacuum plenum has been developed. The printer includes a media transport system with a vacuum plenum and a belt positioned over the vacuum plenum. The belt includes at least one member configured to carry print media in a process direction, a first plurality of holes formed through the at least one member in a first region that carries a first print medium to enable the vacuum plenum to apply a force to hold the first print medium against the at least one member of the belt, a second plurality of holes formed through the at least one member in a second region that carries a second print medium to enable the vacuum plenum to apply the force to hold the second print medium against the at least one member of the belt, and a plurality of slots formed through the at least one member in a third region corresponding to an inter-copy gap that is positioned between the first region and the second region, each slot in the plurality of slots being formed with a first area that is greater than a second area occupied by one hole in the first plurality of holes or the second plurality of holes. The printer also includes a print zone with at least one printhead positioned over the belt. The at least one printhead is configured to eject ink drops toward the first region of the belt and the second region of the belt as the belt moves past the at least one printhead in the process direction.

In another embodiment, a belt for a media transport system in an inkjet printer that reduces air flow at inter-copy gaps between media on a belt moving over a vacuum plenum has been developed. The belt includes at least one member configured to carry print media in a process direction, a first plurality of holes formed through the at least one member in a first region that carries a first print medium to enable the vacuum plenum to apply a force to hold the first print medium against the at least one member of the belt, a second plurality of holes formed through the at least one member in a second region that carries a second print medium to enable the vacuum plenum to apply the force to hold the second print medium against the at least one member of the belt, and a plurality of slots formed through the at least one member in a third region corresponding to an inter-copy gap that is positioned between the first region and the second region, each slot in the plurality of slots being formed with a first area that is greater than a second area occupied by one hole in the first plurality of holes or the second plurality of holes.

BRIEF DESCRIPTION OF THE DRAWINGS

The foregoing aspects and other features of a media transport system using a belt to transport print media and an inkjet printer including the media transport system are explained in the following description, taken in connection with the accompanying drawings.

DETAILED DESCRIPTION

Figure 1:
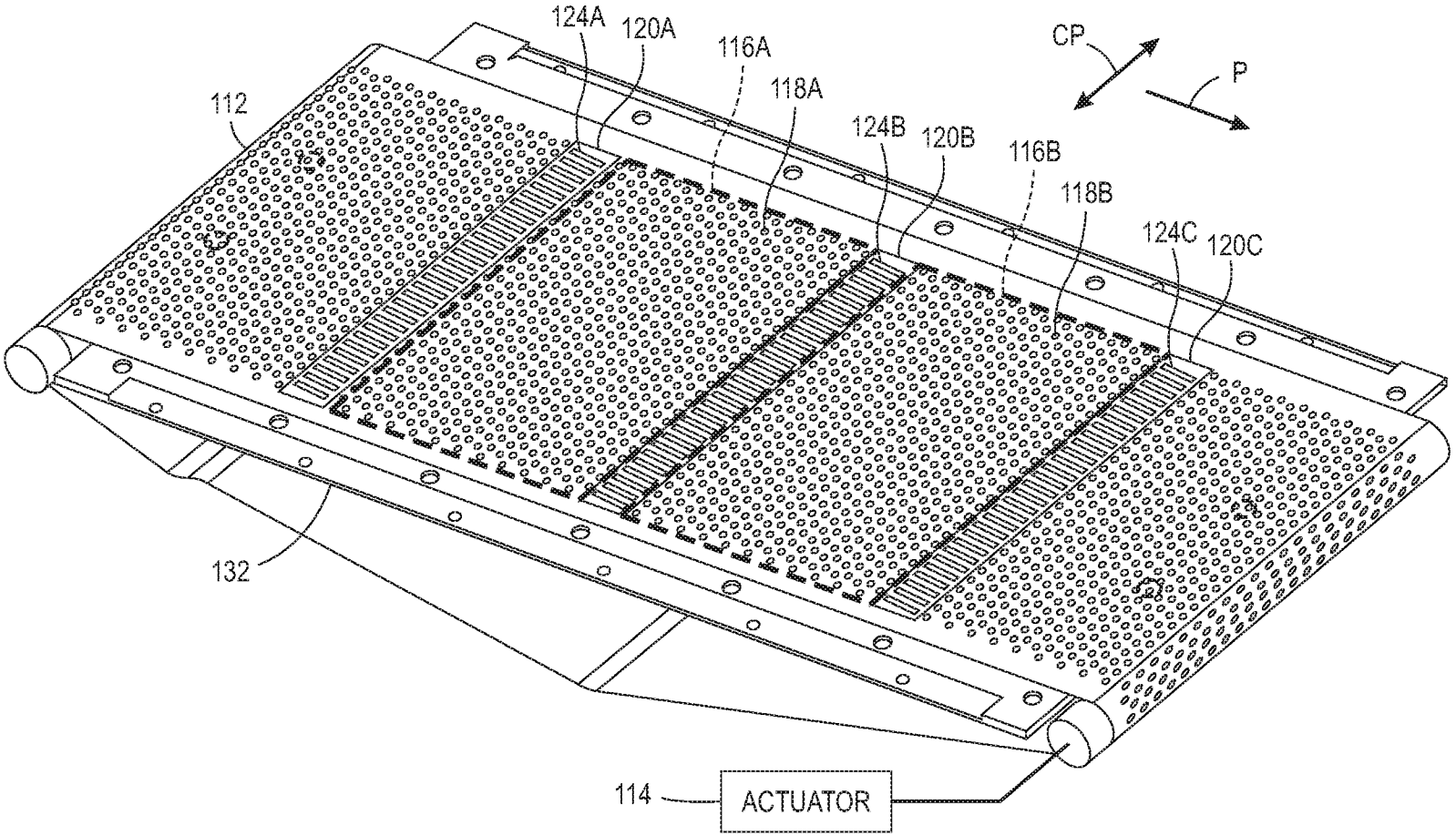
FIG. 1 is a diagram depicting a media transport system including an embodiment of a belt that is formed with slots in inter-copy gap regions of the belt.

For a general understanding of the environment for the device disclosed herein as well as the details for the device, reference is made to the drawings. In the drawings, like reference numerals designate like elements.

As used herein, the word "printer" encompasses any apparatus that produces images with colorants on media, such as digital copiers, bookmaking machines, facsimile machines, multi-function machines, and the like. As used herein, the term "process direction" (P) refers to a direction of movement of a belt that carries print media past at least one printhead in a print zone. For example, a media transport system includes a belt that moves in the process direction. The belt has a surface that carries print media along the process direction past at least one printhead in a print zone. At least one printhead ejects drops of ink to form printed images on each print medium. A location that is "upstream" in the process direction relative to a component in the printer refers to a location that the print media passes prior to reaching the component, such as an upstream location that a print medium passes prior to reaching a printhead or other component in the printer. A location that is "downstream" in the process direction relative to a component in the printer refers to a location that the print media passes after reaching the component, such as a downstream location that a print medium passes after passing a printhead or other component in the printer. As used herein, the term "cross-process" direction (CP) refers to an axis that is perpendicular to the process direction along a surface of the belt and the print media on the surface of the belt.

In isolation from the use of the belt within a printer, the process direction also refers to the longitudinal axis of the belt along the circumference of the loop for an endless belt. In isolation from the use of the belt within a printer, the cross-process direction also refers to the lateral axis of the belt, which is the width of the belt between the two lateral edges in an endless belt.

As used herein, the term "belt" refers to at least one moveable member in a media transport system that has a surface configured to carry print media in the process direction through the printer. The belts described herein include openings that enable a vacuum plenum that is positioned on a bottom side of the belt to apply a vacuum force that draws air through openings that are formed in the belt. The vacuum force from the plenum holds sheets of print media, such as paper or plastic sheets, securely to the top surface of the belt. Openings in the belt that are not covered by a media sheet enable the vacuum plenum to draw air through the belt. Examples of belts include, but are not limited to, rubberized endless belts formed from at least one member that optionally include composite fabric layers, segmented belts formed from flexible or rigid members that join together to form the surface of the belt, and any other suitable belt structure.

As used herein, the term "vacuum plenum" refers to an apparatus that includes at least one chamber, a vacuum source, such as an electrical pump or fan system, and at least one opening that is configured to engage one surface of a belt in a media transport system. The vacuum source draws air through holes that are formed in the belt through the chamber and out an exhaust opening. A print medium placed on a surface of the belt opposite the surface that engages the opening to the chamber in the vacuum plenum covers a portion of the holes in the belt. The vacuum generated in the vacuum plenum applies a downward force to the print medium through the holes in the belt that are covered by the print medium.

As used herein, the terms "hole" and "slot" both refer to types of openings that are formed through at least one member in a belt. More particularly, a "hole" refers to an opening that is formed through the belt with a shape that is substantially equal in both the process direction and the cross-process direction from a center of the hole. For example, a circular shaped opening is one common example of a hole, although other geometric forms including squares, pentagons, hexagons, octagons, plus-sign crosses, and the like can form holes as well. The "slot" refers to an opening that is formed through the belt in which one axis of the opening is substantially longer than the other axis in either the process direction or the cross-process direction. An elongated rectangle with a length that runs along either the process direction axis or the cross-process direction axis of the belt is one example of a slot, although other elongated shapes including ellipses can form slots as well. Furthermore, as described in further detail below, the slots in a belt are formed with an area that is larger than the areas of the holes in the belt to enable the slots to reduce the overall variation in pressure that occurs when a vacuum plenum draws air through the slots compared to drawing air through the holes.

As used herein, the term "inter-copy gap" refers to predetermined regions of the belt that that lie between print media while the belt carries the print media in the process direction. In one configuration, an inter-copy gap of approximately 64 millimeters in length along a process direction separates adjacent media sheets on the belt, although alternative embodiments use larger or smaller inter-copy gap sizes. The inter-copy gaps repeat at regular intervals along the length of the belt corresponding to the predetermined length of a print medium (e.g., every 210 mm or 297 mm for size A4 paper depending upon the paper being arranged width-wise or length-wise, respectively, on the belt).

FIG. 1 is a diagram depicting a belt 112 and a platen 132 of a vacuum plenum that is part of a media transport system in a printer. The belt 112 is an endless belt formed into a loop from at least one member, such as an elongated rubberized sheet that optionally includes composite fabric layer. In other embodiment, the belt 112 is formed from multiple members that are joined together into an endless belt including segmented belts that are formed from flexible or rigid members to form the surface of the belt. During operation of a printer, an electromechanical actuator 114 rotates one or more rollers that move the belt 112 in a process direction P. The belt 112 travels over the platen 132 in a print zone of a printer. As described in more detail below, the platen 132 places the belt 112 in communication with a vacuum plenum in the printer. The vacuum plenum draws air through holes in the belt 112 in the regions 116A and 116B to apply a vacuum force to hold media sheets securely in place against the surface of the belt 112. The vacuum plenum also draws air through slots that are formed in the regions of the belt 112 forming inter-copy gaps 120A-120C.

In FIG. 1, the belt 112 includes multiple regions, including a first region 116A and a second region 116B, that are formed with a size and shape corresponding to a print medium that is carried on the surface of the belt 112 past one or more printheads in a print zone of a printer. For example, the first region 116A and the second region 116B both have a size and shape corresponding to a predetermined media sheet size, such as an A4 or Letter sized media sheet, although different configurations of the belt 112 accept a wide range of different media sizes.

In the belt 112, both the first region 116A and the second region 116B include a plurality of holes that are formed through the at least one member in the belt 112. The holes enable the vacuum plenum to apply vacuum force to the media sheets via openings in the platen 132 and the holes. During operation of the media transport system, the first region 116A and the second region 116B both receive media sheets prior to passing one or more printheads in a print zone of an inkjet printer. For example, the hole 118A in the first region 116A applies a vacuum force to a media sheet that is placed on the surface of the belt 112 in the region 116A. Similarly, the hole 118B in the region 116B applies a vacuum force to a media sheet that is placed on the surface of the belt 112 in the second region 116B.

In the embodiment of FIG. 1, the first region of the belt 116A includes a two-dimensional array of the holes that place vacuum pressure against the surface of a print medium at a large number of locations. The holes are formed in staggered rows in the region 116A. In the embodiment of FIG. 1, the hole 118A and each of the other holes in the first region 116A is formed with a circular shape having a diameter of 1.8 millimeters. The two-dimensional array of holes includes staggered rows of the holes with a distance of 6.5 millimeters between the centers of adjacent holes to provide a uniform vacuum force across the surface of the media sheet. The second region 116B similarly includes the array of holes with the hole 118B and each of the other holes having a circular shape and a diameter of 1.8 millimeters and the holes being arranged with a 6.5 millimeter separation between adjacent holes. The precise sizes and densities of the holes may vary in different embodiments of the belt 112. The two-dimensional arrangement of holes in each of the regions 116A and 116B enable each of the holes in the corresponding regions to engage a print medium and apply a vacuum force to the print medium as the belt 112 carries the print medium over the platen 132 and the vacuum plenum. The two-dimensional arrays of holes in each of the regions 116A and 116B are formed with a size and shape that enables all of the holes in each region to engage the surface of a print medium.

The belt 112 also includes inter-copy gap regions that are located between adjacent media sheets on the belt 112. In FIG. 1, the inter-copy gap regions 120A and 120B are located on the upstream and downstream sides, respectively, of the first region 116A in the process direction P. The inter-copy gap regions 120B and 120C are located on the upstream and downstream sides, respectively, of the second region 116B in the process direction P. In particular, the inter-copy gap 120B forms a third region of the belt 112 that is located between the first region 116A and the second region 116B in the process direction P. The inter-copy gap 120B separates a first media sheet placed on the first region 116A from a second media sheet placed on the second region 116B as the belt 112 moves in the process direction P through a print zone of a printer.

Each of the inter-copy gaps 120A-120C in the belt 112 includes a plurality of slots, including the slots 124A, 124B, and 124C that are formed in the inter-copy gaps 120A, 120B, and 120C, respectively. Each of the slots forms an opening through at least one member of the belt 112 with an area of the slot opening being greater than the area of the opening for any of the holes that engage a print medium, such as the holes 118A or 118B. In the embodiment of FIG. 1, the slots in each of the inter-copy gaps have an elongated rectangular shape and, in one embodiment, are formed with a length of approximately 53 millimeters and a width of 1.8 millimeters. In the belt 112, the slots are arranged in a linear array with the length of each slot being aligned with the process direction P and a separation between the centers of the slots of 6.5 millimeters in the cross-process direction CP. The maximum effective length for a slot in the inter-copy gap regions 120A-120C is approximately the size of the inter-copy gap along the process direction P, which is approximately 64 millimeters in the embodiment of FIG. 1 but may be larger or smaller in different embodiments of the belt 112. The precise sizes and densities of the slots in the inter-copy gaps may vary in different embodiments of the belt 112.

Figure 2:
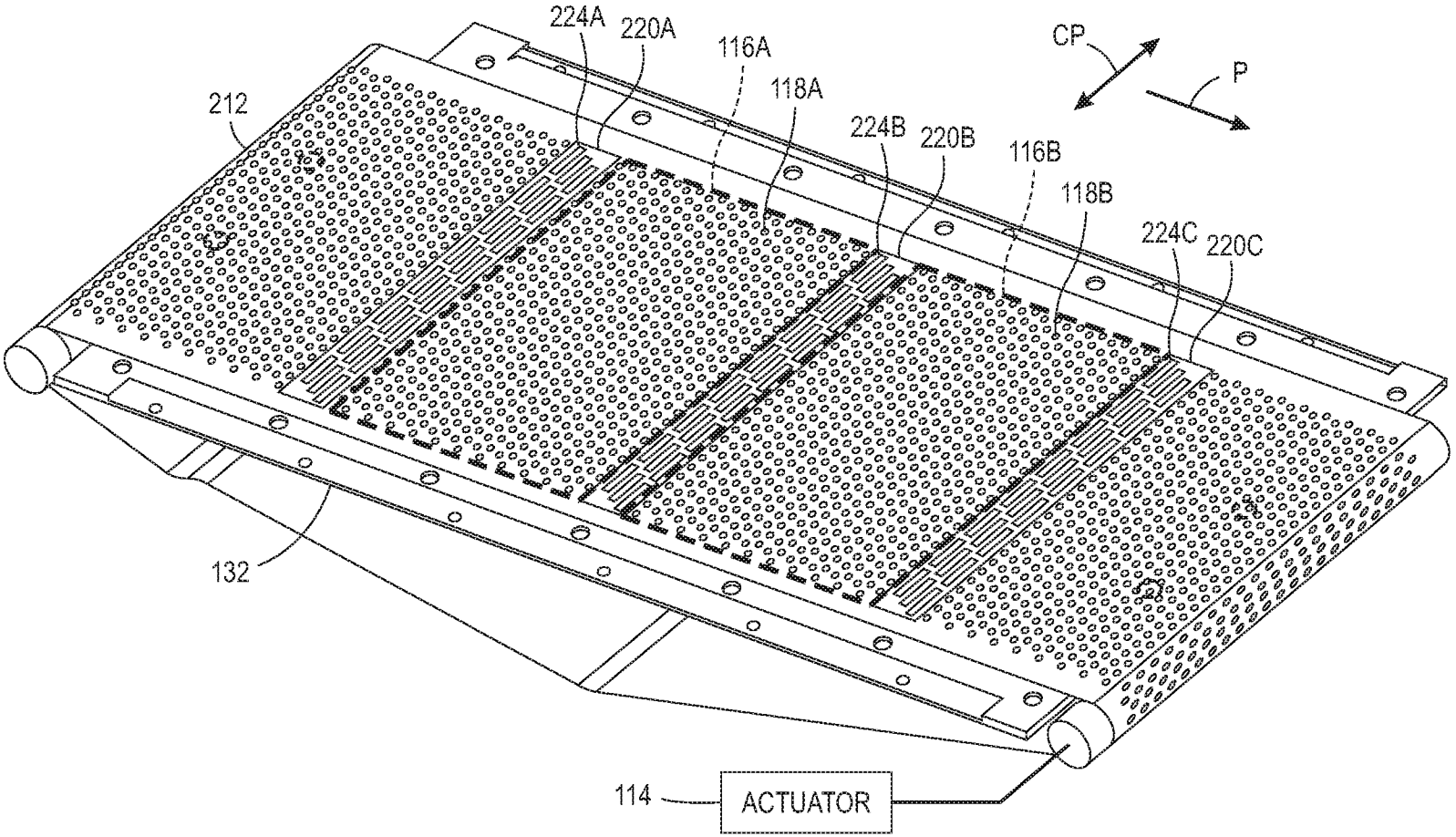
FIG. 2 is a diagram depicting a media transport system including another embodiment of a belt that is formed with slots in inter-copy gap regions of the belt.

The belt configuration of FIG. 1 is one embodiment of a belt that provides slots in one or more inter-copy gap regions to control the flow of air through one or more members in the belt. However, different embodiments of the belt include different arrangements of the slots in the inter-copy gap regions. FIG. 2 depicts one example of another embodiment of a belt 212 that includes the same regions 116A and 116B that carry print media and that each provide an array of holes, such as the holes 118A and 118B in the regions 116A and 116B, respectively. As with the belt 112, the holes in the belt 212 enable a vacuum plenum to apply a suction force that holds the print medium in place against the surface of the belt 212.

In the belt 212, the inter-copy gaps 220A-220C are regions that are formed on either side of the regions 116A and 116B along the process direction P that do not carry the print media. The inter-copy gaps 220A-220C each include a plurality of slots arranged in a two-dimensional array along the cross-process direction CP. For example, the slots 224A, 224B, and 224C, are each arranged in one of the inter-copy gaps 220A, 220B, and 220C, respectively. In the illustrative embodiment of FIG. 2, the slots 224A-224C each have a length of approximately 53 millimeters and a width of 1.8 millimeters, which are similar to the dimensions of the slots in the belt 112. In the belt 212, the maximum effective lengths of the slots, including the slots 224A-224C, can be larger than the lengths of the slots in the belt 112 because the slots in the belt 212 are each formed with a length that is aligned with the cross-process direction CP. The maximum effective length corresponds to the cross-process direction dimension of the belt 212, although in practical embodiments the length of the slots may be shorter to ensure that the slots do not substantially weaken the structure of the belt 212.

Figure 3:
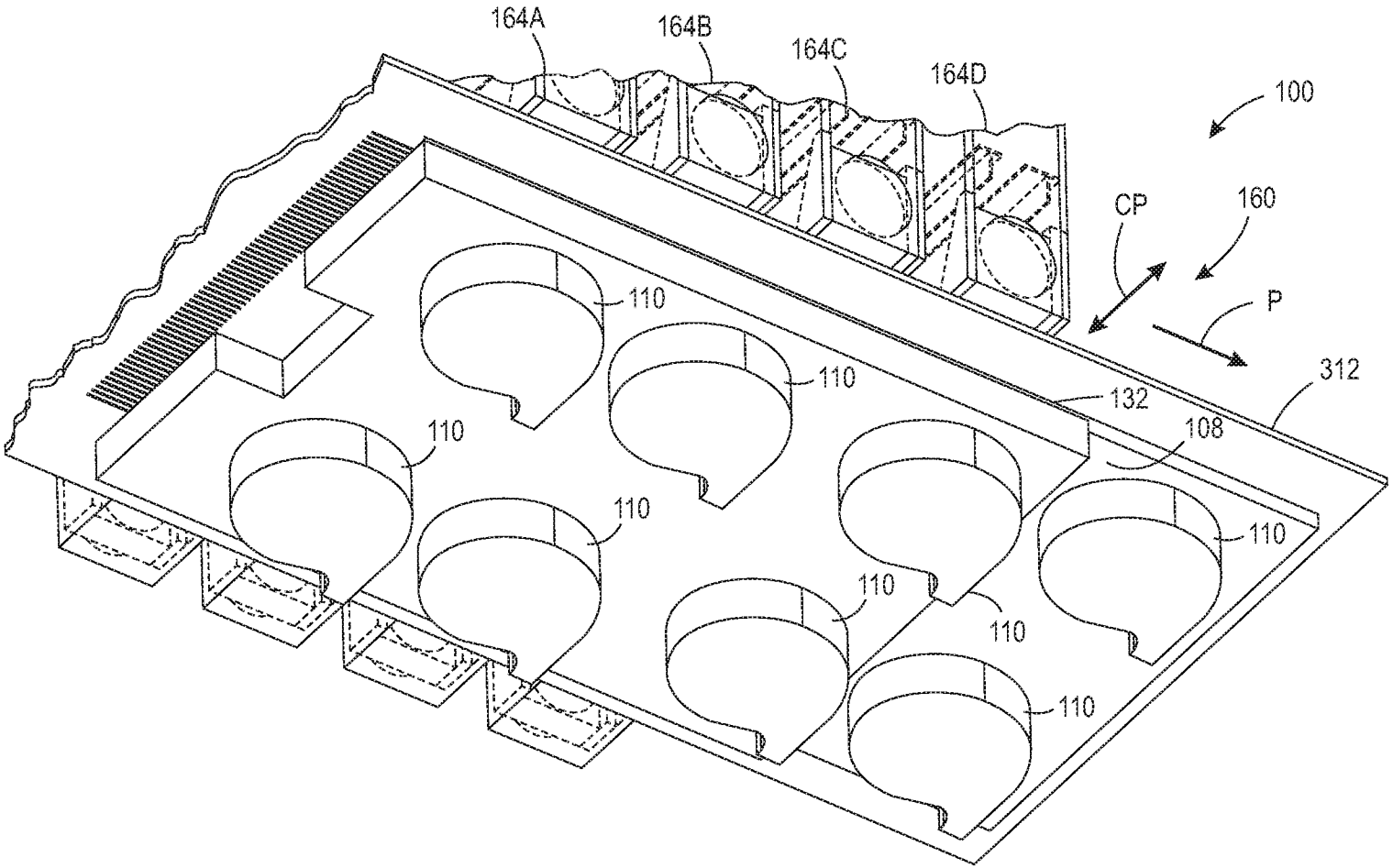
FIG. 3 is a diagram depicting an inkjet printer that includes a media transport system using the belts of FIG. 1 or FIG. 2.

FIG. 3 depicts selected components in an inkjet printer 100 that includes a media transport system using a belt 312 that is embodied as either of the belts 112 or 212 that are described above. While not expressly show in FIG. 3, the printer 100 also includes the actuator 114 or other actuators that move the belt 312 in the process direction P during operation of the printer 100. FIG. 3 depicts the a print zone 160 that includes a set of four printhead units 164A, 164B, 164C, and 164D, a vacuum plenum 108, and multiple vacuum pumps 110 that are connected to the vacuum plenum 108. In the embodiment of FIG. 3, the vacuum plenum 108 includes the platen 132, and the vacuum plenum 108 is located under a belt 312. In the print zone 160, the printhead units 164A-164D are located above the surface of the belt 312.

The vacuum plenum 108 includes a chamber that is placed in communication with the belt 312 via openings in the platen 132. The vacuum plenum 108 is further connected to the pumps 110, which are embodied as an array of electric fans. During operation, the fans of the pumps 110 draw air through the belt 312, platen 132, and emit the air from the base of the vacuum plenum 108. The pumps 110 generate a reduced level of pressure in the chamber of the vacuum plenum 108. The reduced level of pressure in the vacuum plenum 108 enables the holes the belt 312 to apply a vacuum force to media sheets that are positioned on the upper surface of the belt 312 and for the slots in the inter-copy gaps of the belt 312 to draw in air from above the upper surface of the belt 312. Alternative embodiments of the vacuum plenum 108 include a different number of pumps.

The print zone 160 includes an array of fours printhead units 164A-164D, although other embodiments include a different number of printhead units. In the printer 100, each of the printhead units 164A-164D is positioned over the upper surface of the belt 112 to enable printheads within each printhead unit to form printed images on the surfaces of print media that the belt 112 carries in the process direction P through the print zone 160. In the illustrative example of FIG. 3, each of the printhead units 164A-164D includes a staggered array of three printheads arranged along the cross-process direction CP to enable printing over the entire width of a media sheet, although alternative embodiments include a different number of printheads. In the printer 100, the different printhead units 164A-164D each eject drops of a single color of ink to enable the printhead units 164A-164D to form multi-color printed images using, for example, cyan, magenta, yellow, black (CMYK) inks or other combinations of ink colors. Each of the printheads in the printhead units 164A-164D includes an array of inkjets that eject drops of ink onto the surface of a print medium in the print zone 160. In the print zone 160, the printheads are located at a comparatively short distance (e.g. on the order of 1.0 to 1.5 millimeters) above the upper surface of the belt 312 to enable the printheads to eject drops of ink onto media sheets with a high degree of precision.

Referring again to FIG. 1 and FIG. 2, both of the belt embodiments 112 and 212 include slots that place the vacuum plenum in communication with the belt surface through the platen 132. Unlike the holes that are formed in the first region 116A and the second region 116B, however, the slots in the inter-copy gaps do not directly engage a print medium or other object as the belt 112 moves in the process direction P through a print zone in the printer. Instead, the slots enable a flow of air in the region above the belt 112 through each of the slots and the platen 132 into the vacuum plenum. As described above, the area of each slot is larger than the area of the holes that otherwise occupy the inter-copy regions of prior-art vacuum belts. For example, in the embodiments of the belts 112 and 212, each hole has an area of approximately 2.5 $mm^2$ and each slot has an approximate area of 95 $mm^2$ although some slot embodiments may have substantially greater areas. The smaller and numerous holes in the inter-copy gaps of prior-art belts produce a much larger level of suction and corresponding variation in the pressure levels above the surface of a belt compared to the larger slots that are formed in the inter-copy gap regions of the belts 112 and 212. Thus, the smaller holes in the regions 116A and 116B provide a higher level of suction to secure the media sheets to a belt surface, and the larger slots in the inter-copy gap regions 120A-120C or 220A-220C of the belts 112 and 212 provide reduced suction and corresponding pressure variation levels in the print zone 160.

It is believed that the larger areas of the slots in the inter-copy gap regions of the belts 112 and 212 produce a substantial reduction in the variations in air pressure above the belt in the print zone 160 as the inter-copy gaps in the belt move past the printhead units 164A-164D. As depicted above in FIG. 3, the printheads in the print units 164A-164D are located within a close proximity of the surface of the belt 312 to enable high-speed and high-precision printing onto the surfaces of print media in the print zone 160. Since the belt 312 provides a substantial reductions in the air pressure variation in the region above the surface of the belt 312, the nozzles of the inkjets in the printheads of the printhead units 164A-164D also experience substantially reduced deviations in pressure. The reduction in the pressure variation also reduces or eliminates the occurrences of inoperable inkjets in the printheads in comparison to media transport systems that use prior art belts.

Figure 4A:
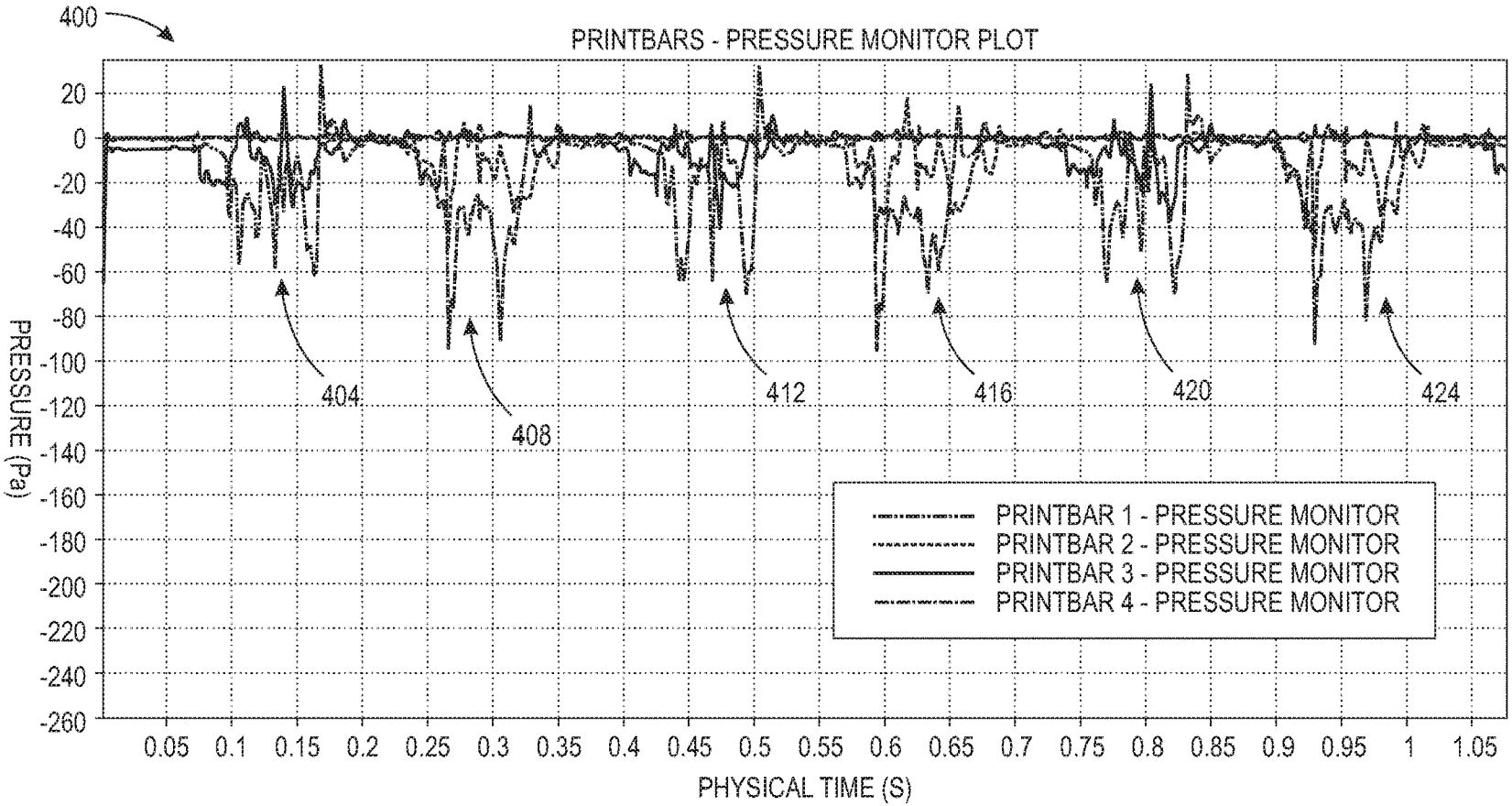
FIG. 4A is a graph depicting variations in air pressure in a region above the belts of FIG. 1 and FIG. 2 over time as an inter-copy gap in the belt passes a printhead in a printer.
Figure 4B:
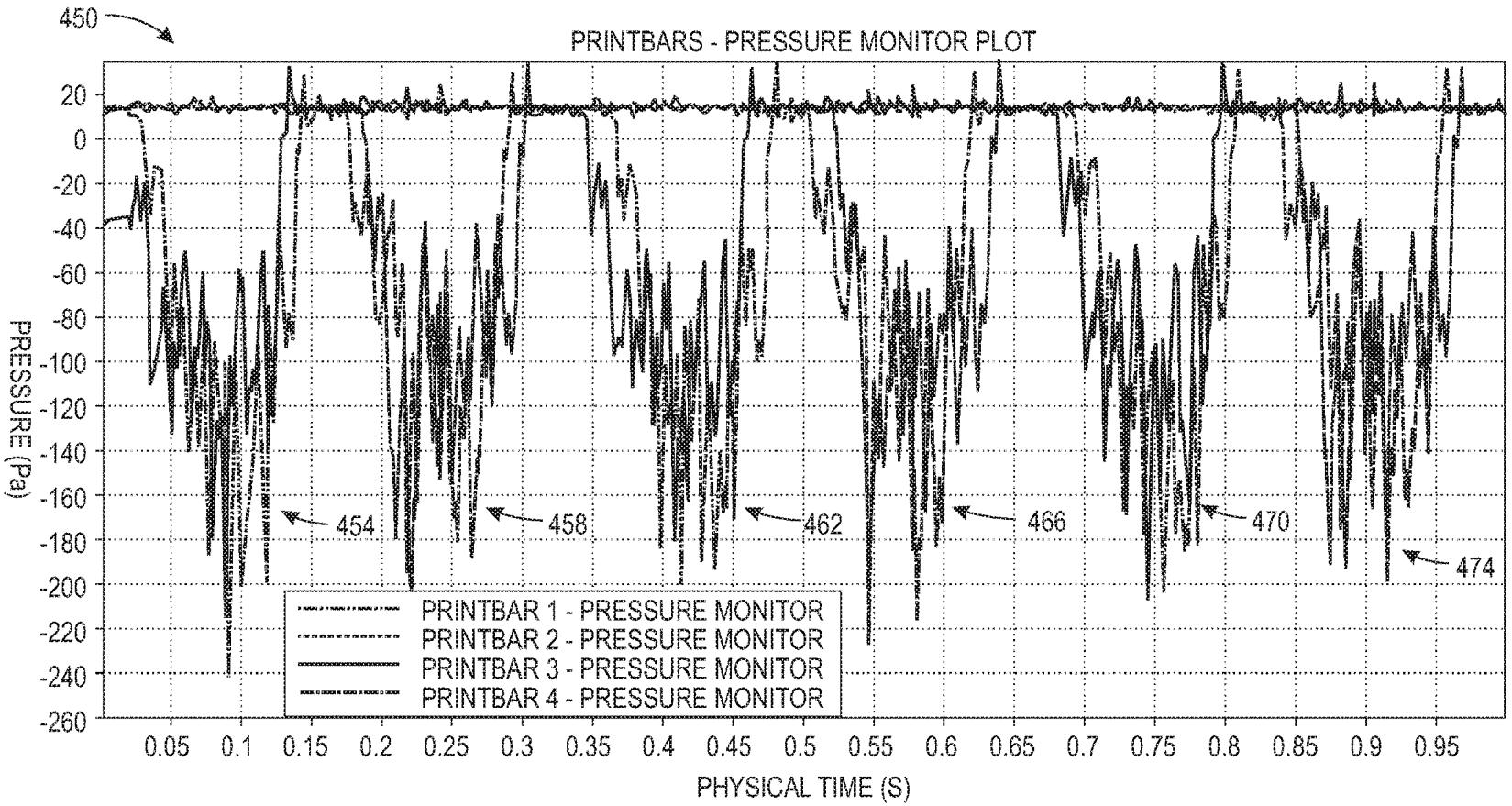
FIG. 4B PRIOR ART
FIG. 4B a graph depicting variations in air pressure in a region above a prior art belt over time as an inter-copy gap in the prior art belt passes a printhead in a printer.

FIG. 4A and FIG. 4B provide additional data to illustrate the reductions in pressure variation that the printheads in the printer 100 experience using either of the belt embodiments 112 or 212 in a media transport system compared to the prior art. Both FIG. 4A and FIG. 4B depict operation of a printer that uses a vacuum plenum, such as the vacuum plenum 108 of FIG. 3, at a uniform level of negative pressure to hold media sheets in place on a belt as the belt carries the sheets through a print zone in a printer. FIG. 4A includes a pressure vs. time graph 400 and FIG. 4B includes another pressure vs. time graph 450. In the graphs 400 and 450, the pressure level 0 represents ambient atmospheric pressure. The graphs 400 and 450 both depict varying levels of negative pressure that are generated near different printhead units in the printer 100 as inter-copy gaps in the belts 112 or 212 (FIG. 4A) or in a prior art belt (FIG. 4B) move past the printhead units in the print zone 160.

FIG. 4B depicts a graph 450 of variations in pressure over time as multiple inter-copy gaps on a prior-art belt pass a series of printhead units over a period of approximately one second during operation of the printer 100. The graph 450 depicts large negative deviations from the ambient air pressure that correspond to the negative pressure that the holes in a prior-art belt produce as the inter-copy gaps of the belt move past different printhead units in the print zone 160. In FIG. 4B, the inter-copy gaps on the prior art belt are staggered so that two different inter-copy gaps pass by two different printhead units substantially simultaneously. Thus, the regions 454, 462, and 470 correspond to times at which two different inter-copy gaps pass the first and third printhead units (e.g. printhead units 164A and 164C of FIG. 3) simultaneously. The regions 458, 466, and 474 correspond to times at which two different inter-copy gaps pass the second and fourth printhead units (e.g. printhead units 164B and 164D of FIG. 3) simultaneously. As depicted in FIG. 4, the printhead units experience substantial variations in pressure of as much as approximately −240 Pascals within a very short period of time.

FIG. 4A depicts another pressure graph 400 of negative pressure levels that the printhead units experience during operation of a media transport system that uses the belts 112 or 212 that are described above. The graph 400 depicts the negative pressure variations for the first and third printhead units in regions 404, 412, and 420, and the negative pressure variations for the second and fourth printhead units in the regions 408, 416, and 424. The graph 400 clearly depicts a substantially smaller variation in pressure near the printhead units because the slots that are formed in the inter-copy gaps produce a much lower level of negative pressure above the surface of the belts 112 or 212 compared to the prior art belts. In particular, in FIG. 4 the maximum level of measured negative pressure is only approximately −90 Pascals, and the average levels of negative pressure are also substantially lower in magnitude than the negative pressure levels that are observed in the prior art configuration of FIG. 4B. Consequently, the media transport system and belts 112 or 212 in the printer 100 reduce the occurrences of inoperable inkjets in the printhead units 164A-164D.

It will be appreciated that variants of the above-disclosed and other features and functions, or alternatives thereof, may be desirably combined into many other different systems, applications or methods. Various presently unforeseen or unanticipated alternatives, modifications, variations or improvements may be subsequently made by those skilled in the art that are also intended to be encompassed by the following claims.

What is claimed:

1. A media transport system comprising:
a vacuum plenum; and
a belt positioned over the vacuum plenum, the belt comprising:
at least one member configured to carry print media in a process direction;
a first plurality of holes formed through the at least one member in a first region only that carries a first print medium to enable the vacuum plenum to apply a force to hold the first print medium against the at least one member of the belt;
a second plurality of holes formed through the at least one member in a second region only that carries a second print medium to enable the vacuum plenum to apply the force to hold the second print medium against the at least one member of the belt; and
a plurality of slots formed through the at least one member in a third region corresponding to an inter-copy gap only that is positioned between the first region and the second region, each slot in the plurality of slots being formed with a first area that is greater than a second area occupied by one hole in the first plurality of holes or the second plurality of holes wherein the plurality of slots is arranged with a length of each slot being aligned with the process direction of the belt.

2. The media transport system of claim 1 further comprising:
an actuator configured to move the belt over the vacuum plenum in the process direction to enable the belt to carry the first print medium and the second print medium in the process direction.

3. The media transport system of claim 1, the first plurality of holes further comprising:
a two-dimensional array of holes arranged in the first region with a 6.5 millimeter spacing between holes in the two-dimensional array and each hole being formed with a circular shape having a diameter of 1.8 millimeters.

4. The media transport system of claim 3, the plurality of slots further comprising:
an array of slots arranged in the third region with a 6.5 millimeter spacing between the slots, a width of each slot being at least 1.8 millimeters, and a length of each slot being approximately 53 millimeters.

5. The media transport system of claim 1 wherein the plurality of slots is arranged with a length of each slot being aligned with a cross-process direction of the belt.

6. A printer comprising:
a media transport system comprising:
a vacuum plenum; and
a belt positioned over the vacuum plenum, the belt comprising:
at least one member configured to carry print media in a process direction;
a first plurality of holes formed through the at least one member in a first region only that carries a first print medium to enable the vacuum plenum to apply a force to hold the first print medium against the at least one member of the belt;
a second plurality of holes formed through the at least one member in a second region only that carries a second print medium to enable the vacuum plenum to apply the force to hold the second print medium against the at least one member of the belt; and
a plurality of slots formed through the at least one member in a third region corresponding to an inter-copy gap only that is positioned between the first region and the second region, each slot in the plurality of slots being formed with a first area that is greater than a second area occupied by one hole in the first plurality of holes or the second plurality of holes; wherein the plurality of slots is arranged with a length of each slot being aligned with the process direction of the belt; and
a print zone comprising:
at least one printhead positioned over the belt, the at least one printhead being configured to eject ink drops toward the first region of the belt and the second region of the belt as the belt moves past the at least one printhead in the process direction.

7. The printer of claim 6, the media transport system further comprising:
an actuator configured to move the belt over the vacuum plenum in the process direction to enable the belt to carry the first print medium and the second print medium in the process direction.

8. The printer of claim 6, the first plurality of holes further comprising:
a two-dimensional array of holes arranged in the first region with a 6.5 millimeter spacing between holes in the two-dimensional array and each hole being formed with a circular shape having a diameter of 1.8 millimeters.

9. The printer of claim 8, the plurality of slots further comprising:
an array of slots arranged in the third region with a 6.5 millimeter spacing between the slots, a width of each slot being at least 1.8 millimeters, and a length of each slot being approximately 53 millimeters.

10. The printer of claim 6 wherein the plurality of slots is arranged with a length of each slot being aligned with a cross-process direction of the belt.

11. A belt for a media transport system in a printer comprising:
at least one member configured to carry print media in a process direction;

a first plurality of holes formed through the at least one member in a first region only that carries a first print medium to enable the vacuum plenum to apply a force to hold the first print medium against the at least one member of the belt;

a second plurality of holes formed through the at least one member in a second region only that carries a second print medium to enable the vacuum plenum to apply the force to hold the second print medium against the at least one member of the belt; and a plurality of slots formed through the at least one member in a third region corresponding to an inter-copy gap only that is positioned between the first region and the second region, each slot in the plurality of slots being formed with a first area that is greater than a second area occupied by one hole in the first plurality of holes or the second plurality of holes wherein the plurality of slots is arranged with a length of each slot being aligned with the process direction of the belt.

12. The belt of claim 11, the first plurality of holes further comprising:

a two-dimensional array of holes arranged in the first region with a 6.5 millimeter spacing between holes in the two-dimensional array and each hole being formed with a circular shape having a diameter of 1.8 millimeters.

13. The belt of claim 12, the plurality of slots further comprising:

an array of slots arranged in the third region with a 6.5 millimeter spacing between the slots, a width of each slot being at least 1.8 millimeters, and a length of each slot being approximately 53 millimeters.

14. The belt of claim 11 wherein the plurality of slots is arranged with a length of each slot being aligned with a cross-process direction of the belt.

* * * * *